US005117788A

United States Patent [19]

Blaser

[11] Patent Number: 5,117,788

[45] Date of Patent: Jun. 2, 1992

[54] APPARATUS FOR CONTROL OF PRESSURE IN INTERNAL COMBUSTION ENGINES

[75] Inventor: Richard F. Blaser, Edgewater, Md.

[73] Assignee: Sonex Research, Inc., Annapolis, Md.

[21] Appl. No.: 915,899

[22] Filed: Oct. 6, 1986

Related U.S. Application Data

[63] Continuation of Ser. No. 712,461, Mar. 15, 1985, abandoned, which is a continuation of Ser. No. 108,960, Dec. 31, 1979, abandoned, which is a continuation of Ser. No. 733,962, Oct. 19, 1976, abandoned.

[51] Int. Cl.[5] ..... F02D 33/02

[52] U.S. Cl. ..... 123/193.6; 123/286

[58] Field of Search ..... 123/193 P, 193 CP, 279, 123/286, 295, 255, 280, 289

[56] References Cited

U.S. PATENT DOCUMENTS

| | | | |
|---|---|---|---|
| 1,165,086 | 12/1915 | Ford | 123/27 R |
| 1,290,374 | 1/1919 | Shaw | 123/504 |
| 1,803,262 | 4/1931 | Lang | 123/261 |
| 1,803,263 | 4/1931 | Lang | 123/268 |
| 1,816,432 | 7/1931 | Hill | 123/262 |
| 1,825,658 | 10/1931 | Dumanois | 123/260 |
| 1,901,838 | 3/1933 | Baur | 123/193 R |
| 1,937,655 | 12/1933 | Lang | 123/26 |
| 1,944,352 | 1/1934 | Lang | 123/26 |
| 1,981,874 | 11/1934 | Mock | 123/32 C |
| 2,076,030 | 4/1937 | Kahllenberger | 123/275 |

(List continued on next page.)

FOREIGN PATENT DOCUMENTS

| | | | |
|---|---|---|---|
| 648651 | 7/1937 | Fed. Rep. of Germany . | |
| 2114901 | 9/1972 | Fed. Rep. of Germany . | |
| 863222 | 3/1941 | France | 123/193 P |
| 16-13767 | 9/1941 | Japan . | |
| 46-23521 | 7/1971 | Japan . | |
| 49-113008 | 10/1974 | Japan . | |
| 351633 | 7/1931 | United Kingdom . | |

OTHER PUBLICATIONS

Examination of the Material Presented in "The Controlled Heat Balanced Cycle", Nov. 1974, by A. Pouring, Sonex Research, Inc., Jan. 1985.

Test Evaluation of Blaser Configured Laboratory Engine, by D. Steinmeyer et al., BKM, Inc., Aug. 1986.

"The Controlled Heat Balanced Cycle" by Blaser et al. APS Cal. Tech. Nov. 1974.

*Primary Examiner*—Joseph L. Dixon

*Attorney, Agent, or Firm*—Bacon & Thomas

[57] ABSTRACT

An improved apparatus and technique for providing increased efficiency and relatively pollutant free operation of internal combustion engines. An internal combustion engine's gas cycle is refined by forming a secondary balancing non-combusting chamber within the main combustion chamber of each cylinder. The balancing chamber is constructed on a piston surface or within the piston body and operates as a pressure exchange or wave generator during the gas cycle of the internal combustion engine. This permits control of the pressure and temperature within the combustion chamber during the liberation of heat caused by combustion of fuel and air on the power cycle of the engine. The apparatus, the balancing chamber, controls pressure and temperature during this cycle by introducing expansion and compression waves, in the combustion zone during burning of the fuel, that follow one another in sequence without interruption throughout the entire power cycle of each cylinder of the internal combustion engine. The oscillating pressure exchange between the expansion and the compression waves within the combustion chamber during burning of the fuel in each cylinder supplies clean air to support more complete combustion and provides lower combustion temperatures and pressures during operating of the internal combustion engine, thus decreasing the formation of engine exhaust pollutants.

4 Claims, 6 Drawing Sheets

U.S. PATENT DOCUMENTS

| | | | |
|---|---|---|---|
| 2,076,226 | 4/1937 | Cummins | 123/255 |
| 2,098,031 | 11/1937 | Essl | 123/256 |
| 2,173,081 | 9/1939 | Barkeij | 123/275 |
| 2,446,280 | 8/1948 | Hancock | 123/193 |
| 2,573,536 | 10/1931 | Bodine, Jr. | 123/265 |
| 2,662,514 | 12/1953 | Bokine, Jr. | 123/660 |
| 2,662,516 | 12/1953 | Bodine, Jr. | 123/660 |
| 2,662,517 | 12/1953 | Bodine, Jr. | 123/660 |
| 2,758,576 | 8/1956 | Schlamann | 123/27 R |
| 2,910,826 | 11/1959 | Mansfield | 123/299 |
| 2,917,031 | 12/1959 | Nestorovic | 123/660 |
| 2,991,766 | 7/1961 | Candelise | 123/126 |
| 2,991,767 | 6/1965 | Candelise | 123/126 |
| 3,186,390 | 6/1965 | Galic | 123/531 |
| 3,408,992 | 11/1968 | von Seggern et al. | 123/277 |
| 3,561,412 | 2/1971 | Yagi et al. | 123/119 DB |
| 3,730,163 | 5/1973 | Elsbett et al. | 123/193 P |
| 3,810,454 | 5/1974 | Hunt | 123/124 R |
| 3,897,769 | 8/1975 | Jozlin | 123/37 |
| 3,898,965 | 8/1975 | Fischer | 123/119 D |
| 3,919,982 | 11/1975 | Goto et al. | 123/295 |
| 3,923,032 | 12/1975 | Studenroth | 123/191 S |
| 3,991,729 | 11/1976 | Notaro | 123/124 R |
| 4,023,541 | 5/1977 | Sakamoto | 123/26 |
| 4,060,059 | 11/1977 | Blaser | 123/568 |
| 4,067,301 | 1/1978 | Jarry | 123/26 |
| 4,079,703 | 3/1978 | Yamane et al. | 123/32 SP |
| 4,104,989 | 8/1978 | Resler, Jr. | 123/430 |

APPARATUS FOR CONTROL OF PRESSURE IN INTERNAL COMBUSTION ENGINES

This application is a continuation of application Ser. No. 712,461 filed Mar. 15, 1985 (now abandoned), which is a continuation of application Ser. No. 108,960, filed Dec. 31, 1979 (now abandoned), which is a continuation of application Ser. No. 733,962, filed Oct. 19, 1976 now abandoned).

BACKGROUND OF THE INVENTION

The present invention relates to an apparatus and technique for increasing the efficiency of operation of an internal combustion engine and more particularly to an improved apparatus and technique that permits control of generated pressures and temperatures during combustion of fuel in the combustion chamber of an internal combustion engine for achieving predetermined parameters of pressure and temperature within the combustion zone in order to decrease the amount of pollutants exhausted by the engine during operation.

Efficient conversion of energy into useful work has been the goal of engine designers since the creation of internal combustion engines utilizing the Otto cycle, i.e. reciprocating, rotary, diesel engines and the like. In view of the scarcity and high cost of engine fuels, engineers and engine designers have been grappling with the fundamental problems of exhaust emission pollutants and increased fuel economy, yet striving to improve performance in these areas without sacrificing engine performance and efficiency. This has produced internal combustion engines that are operating in a critical compromise of fuel/air mixture composition, pressure and temperature that results in the engine generating and discharging harmful pollutants (CO, NOX and HC) in order to achieve adequate performance.

To deal with the NOX emissions designers have retarded spark and employed such devices as exhaust gas recirculation systems, each which decreases overall engine performance, with a resultant decrease in engine performance and which further cause increases in HC and CO emissions. These increased HC and CO emissions must be cleared up by expensive catalytic converters which in turn require unleaded fuels.

Continued distortion of the combustion process in internal combustion engines can only result in a hodge potch of engine control devices that increases engine manufacturing cost and result in low engine performance with low fuel economy.

Realization in both industry and the government that internal combustion engines will require drastic design changes to achieve permissible government pollution standards has resulted inconsiderable developmental efforts to investigate the combustion process. These efforts have resulted in various techniques such as changing the size and shape of the combustion chamber, relocation of the spark within the combustion chamber, the use of multiple-source ignition schemes and the use of stratified charge designed combustion chambers.

Various modifications of a combustion chamber shape into a hemispherical chambers with changes in conventional spark locations by designing spark plugs with extended gap designs has reduced HC emissions but this design has mechanical manufacturing difficulties that far out weigh the amount of reduced emissions obtained.

Another technique presently being utilized is the use of a multiple-source ignition configuration to cause creation of a torch-like flame to shoot into a homogeneous-lean air/fuel mixture within the combustion chamber with the torch fueled by the same fuel as the main chamber. The torch ignition mixture is mechanically separated from the main chamber by an antechamber constructed in the engine head to open into the main combustion chamber.

Another popular scheme is the stratified charge engine (SC) configuration which can have numerous variations. The basic idea of the SC engine involves introduction of a rich, easily ignitable mixture in the vicinity of the spark plug and a very lean mixture throughout the rest of the chamber, so as to have a differing air/fuel ratio in various areas within the cylinder chamber, rich in some lean in others, with the resulting overall air/fuel ratio considerably leaner than stoichiometric. The burning takes place in stages with a small volume of rich air/fuel mixture being ignited first to create a flame that spreads out into the combustion chamber charged with very lean air/fuel mixture causing ignition of these areas more thoroughly and burning them more completely than in conventional internal combustion engines.

The above are a few of the more pertinent devices of the numerous proposals that have been set forth to reduce pollution and increase engine and fuel performance. Each has some distinct disadvantage because of its interaction with other engine parameters inherent in the Otto cycle or diesel cycle engine. In view of this there has been created a need in the industry of an internal combustion engine operating on a gas cycle that has the characteristics of the Otto cycle but which has a process of combustion that is time controlled and will operate with the advantage of high compression ratio and fuel rich air ratios with the efficiency and total fuel oxidation of the diesel without its disadvantages of high pressure, high temperature and knock tendency.

Accordingly, the present invention has been developed to overcome the specific shortcomings of the above known and similar techniques and to provide an improved apparatus and technique for generating a heat balanced cycle for internal combustion engines with performance, pollution characteristics, and a multifuel burning capability that is not present nor possible with conventional Otto or diesel cycle engines.

SUMMARY OF THE INVENTION

An object of the invention is to reduce the amount of pollution of the atmosphere by exhaust gases from an internal combustion engine.

Another object of the invention is to increase the efficiency of conventional internal combustion engines without substantial modifications.

An object of the invention is to decrease the fuel consumption of an internal combustion engine.

An object of the invention is to provide an internal combustion engine with a controlled heat balanced cycle pressure exchange for achieving a relatively pollution free process of combustion.

A further object is to provide a modified internal combustion engine that is capable of manufacture by existing technology and production machinery.

An object of the present invention is to provide an internal combustion engine that can use a variety of fuels and that generates little or no pollutions in its exhaust gases.

An object of the present invention is to provide an internal combustion engine with a combustion process that reduces peak cycle pressures and temperatures to a lower value than those present in conventional internal combustion engines.

An object is to provide an internal combustion engine that has multifuel operational capabilities.

An object of the present invention is to provide an apparatus that will convert Otto and Diesel cycle reciprocating and rotary engines to operate a controlled heat balanced cycle with pressure exchange.

Accordingly, the general purpose of the invention is to provide a technique and apparatus to refine the Otto cycle of present internal combustion engines to operate on a heat balanced cycle with pressure exchange that has a time dependent natural process of combustion for improving engine performance and eliminating exhaust pollutants. A balancing chamber or air reservoir in communication with the combustion chamber of the internal combustion engine; through a carefully designed this is providing chamber and gap pressure exchange allows operation on the compression and power stroke of the piston throughout combustion and independently of total average cylinder pressure conditions. On the admission or intake stroke air and fuel are sequentially directly admitted via a valving arrangement into the combustion chamber. The decrease in pressure caused by atmospheric pressure and the receding piston draws the air and fuel into the combustion chamber with a non-homogeneous charge of fuel and air that is fuel rich near the intake port and air near the piston. As compression starts the air (with possible slight fuel contamination) is forced into the balancing chamber via a gap or passageway, increasing the pressure within the balancing chamber or reservoir as the pressure increases in the combustion chamber by the piston moving toward TDC. At ignition and burning of the fuel-rich mixture the reaction drives a pressure compression shock wave across the combustion chamber and through the passageway into the balancing chamber or reservoir. Simultaneously, expansion waves from reflected shock waves propagate back towards the combustion chamber causing a pressure imbalance between the combustion and decreasing reservoir flows out into the combustion chamber through the gap for replenishing the air within the combustion chamber for sustaining complete combustion of the fuel. These expansion-compression waves interact throughout the combustion event and act in an oscillatory manner to draw air from the balancing chamber into the combustion chamber a substantial number of times. An additional effect of the alternating expansion-compression waves is to cause stirring at the combustion zone at supersonic through sonic speeds. Passage of weak shock waves into the combustion chamber will fractionate the fuel particles, effectively atomizing them for rapid combustion and thus eliminates the need of atomization of fuel by carburetors or like devices as fuel is drawn in the combustion chamber.

The reservoir in the combustion chamber is formed by providing a centrally supported pressure exchange cap that provides a radially extending lip spaced a predetermined distance from the piston top surface. The diameter dimension of the lip is less than the diameter dimension of the cylinder to form a spaced gap or passageway between the peripheral edge of the lip and the cylinder wall surface. The lip is heated by the burning gases during the combustion cycle and acts as a heat exchanger to provide heating of gases in the combustion chamber during the compression cycle. Fuel is fed into the combustion chamber by means of a carburetor like or a injection like system of fuel supply via an intake manifold and intake valve arrangement. An air inlet is provided to permit atmospheric air pressure to flow directly into the combustion chamber whenever the intake valve opens preceding delivery of the fuel to the combustion chamber to cause substantially fuel free air to be drawn into the combustion chamber ahead of the fuel charge.

BRIEF DESCRIPTION OF THE DRAWINGS

For a more complete understanding of the nature and features of an embodiment of the invention, reference should be made to the following detailed description taken in connection with the accompanying drawings wherein.

DETAILED DESCRIPTION OF THE INVENTION

A comparison of the three ideal gas cycles, Otto cycle, Diesel cycle and heat balanced cycle, follows to provide a better understanding of the heat balanced cycle technique utilized in operation of an internal combustion engine.

Figure 1:
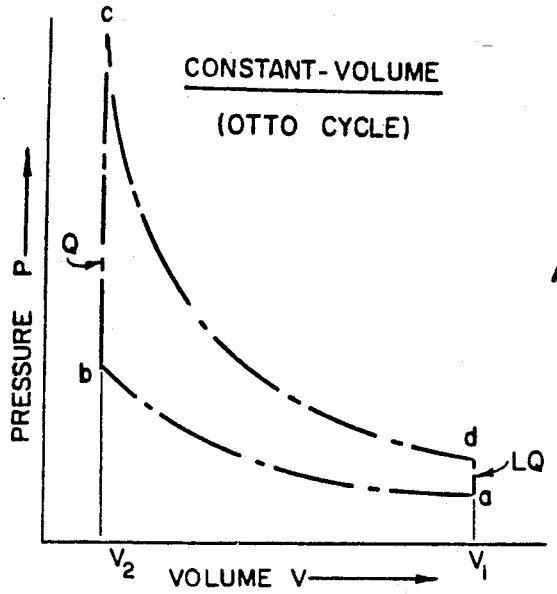
FIG. 1 shows a pressure-volume diagram of the Otto cycle.

Referring now to the graph of FIG. 1, that illustrates a simplified ideal pressure volume diagram of an internal combustion cycle known in the art as the constant volume or Otto cycle. Starting at point a, air at atmospheric pressure is compressed adiabatically in a cylinder to point b, heated at constant volume to point c, allowed to expand adiabatically to point d, and cooled at constant volume to a point a, after which the cycle is repeated. Line ab corresponds to the compression stroke, bc to the heat input by conversion of chemical energy to thermal potential, cd to the working stroke, and da to the exhaust of an internal combustion engine. $V_1$ and $V_2$, are respectively the maximum and minimum volumes of air in the cylinder. The ratio of $V_1/V_2$ is compression ratio of the internal combustion engine.

The heat input Q to the cycle is the quantity of heat supplied at constant volume along the line bc. The, LQ exhaust heat, representing the quantity of loss of heat, is removed along da. The following simplified equations represents the efficiency of the Otto cycle:

$$Q = \text{heat added at constant volume} \quad (1)$$

$$LQ = \text{rejected heat}$$

$$\eta_{Otto} = \frac{AQ - LQ}{AQ} \quad (2)$$

$$\eta_{Otto} = \text{efficiency}$$

Figure 2:
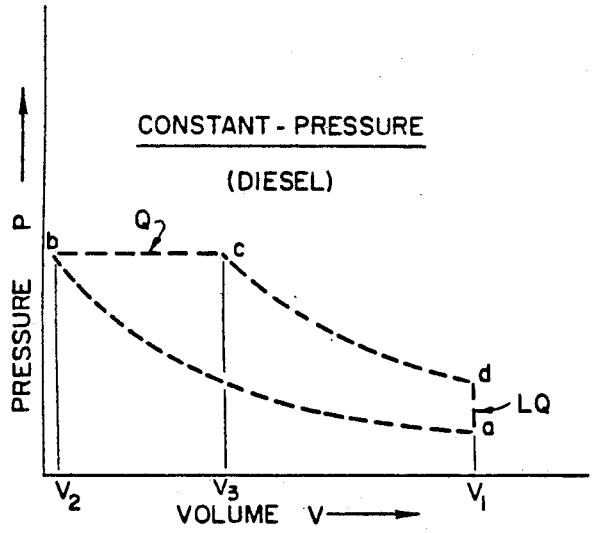
FIG. 2 shows a pressure-volume diagram of the Diesel cycle.

Reference should now be made to FIG. 2 which illustrates a Diesel cycle of an internal combustion engine for an understanding of its operation with respect to the operation of the Otto cycle explained above. The idealized air-Diesel cycle starting at point a, air is compressed adiabatically to point b, heated at constant pressure to point c, expand adiabatically to point d, and cooled at constant volume t point a. Since there is no fuel in the cylinder of a Diesel engine on the compression stroke, preignition cannot occur and the compression ratios may be much higher than that of an internal combustion engine operating on the Otto cycle. Therefore, somewhat higher efficiencies can be obtained than those obtained for the Otto cycle. The following simplified equations define the various parameters of the Diesel engine cycle:

$$Q = \text{heat added at a constant pressure} \quad (3)$$

$$LQ = \text{heat rejected}$$

$$\eta_{Diesel} = \frac{BQ - LQ}{BQ} \quad (4)$$

$$\eta_{Diesel} = \text{efficiency}$$

Figure 3:
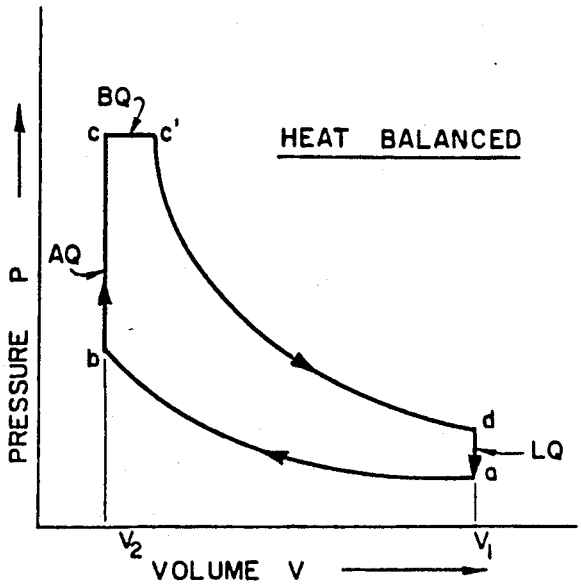
FIG. 3 shows a pressure-volume diagram of the heat balanced cycle.

The heat balanced cycle is illustrated by the pressure-volume diagram of FIG. 3 drawn from the same heat input Q. Line ab corresponds to the adiabatic compression bcc shows that the addition of heat with bc corresponding to the part of the heat added at constant volume and cc' to the remaining heat at constant pressure, c'd is the adiabatic expansion and da the exhaust. Reference to the diagram shows, the quantity of heat Q, added is now divided into two heat quantities, AQ at a constant volume and BQ at a constant pressure, thus maintaining the same quantity of heat Q except that this parameter is divided into two events. The following simplified equations set forth the relationship of the operating parameters of the heat balanced cycle:

$$AQ + BQ = Q \quad (5)$$

$AQ$ is heat added at a constant volume $BQ$ is heat added at a constant pressure Therefore:

$$A + B = 1 \quad (6)$$

The balancing ratio is defined as $$\beta = \frac{B}{A} \quad (7)$$

therefore, $$A = \frac{1}{1+\beta} \text{ and } B = \frac{\beta}{1+\beta}$$

The Otto cycle is the limit when A is 1 and the Diesel cycle is the limit when A=0. The variation of $\beta$ will combine the Otto and Diesel cycles. The efficiency of the heat balanced cycle is expressed as:

$$\eta_\beta = \frac{Q - LQ}{Q} = \frac{AQ + BQ - L[AQ] - L[BQ]}{Q} \quad (9)$$

$$\eta_\beta = \frac{AQ - L[AQ]}{Q} + \frac{BQ - L[BQ]}{Q}$$

$$\eta_\beta = A\frac{AQ - L[AQ]}{AQ} - \frac{BQ - L[BQ]}{BQ}$$

$$\eta_\beta = \frac{AQ - L[QA]}{Q} + \frac{BQ - L[QB]}{Q}$$

$$\eta_\beta = A\frac{AQ - L[QA]}{AQ} + B\frac{BQ - L[QB]}{BQ} \quad (10)$$

Referring to the efficiency of the cycles, $$\eta_\beta = A\eta_V + B\eta_P.$$

$$\eta_V = 1 - \left(\frac{1}{r}\right)^{k-1} : \eta_P = 1 - \left(\frac{1}{r_B}\right)^{k-1} \frac{a_B k - 1}{k(a_B - 1)}$$

$$\text{Calling } \gamma = \left(\frac{P_3}{P_4}\right)^{\frac{1}{k}} \text{ and } r_B = \gamma \cdot r.$$

The efficiency of the Controlled heat balanced cycle is:

$$\eta_\beta = 1 - \left(\frac{1}{r}\right)^{k-1} \frac{1}{1+\beta}\left[1 + \beta\left(\frac{1}{\gamma}\right)^{k-1} \frac{a_B{}^k - 1}{k(a_B - 1)}\right]; \quad (11)$$

The efficiency limits of the heat balanced cycle are those of the Otto and Diesel cycles with the same design compression ratio, or:

$$\eta_\beta \to 1 - \left(\frac{1}{r}\right)^{k-1} \text{ when } \beta \to 0 \text{ or } A \to 1, B \to 0 \text{ Otto cycle}$$

$$\eta_\beta \to 1 - \left(\frac{1}{r}\right)^{k-1} \frac{a^k - 1}{k(a-1)}\beta \text{ when } \to \infty \text{ or } A \to 0, B \to 1$$

Diesel cycle

Figure 4:
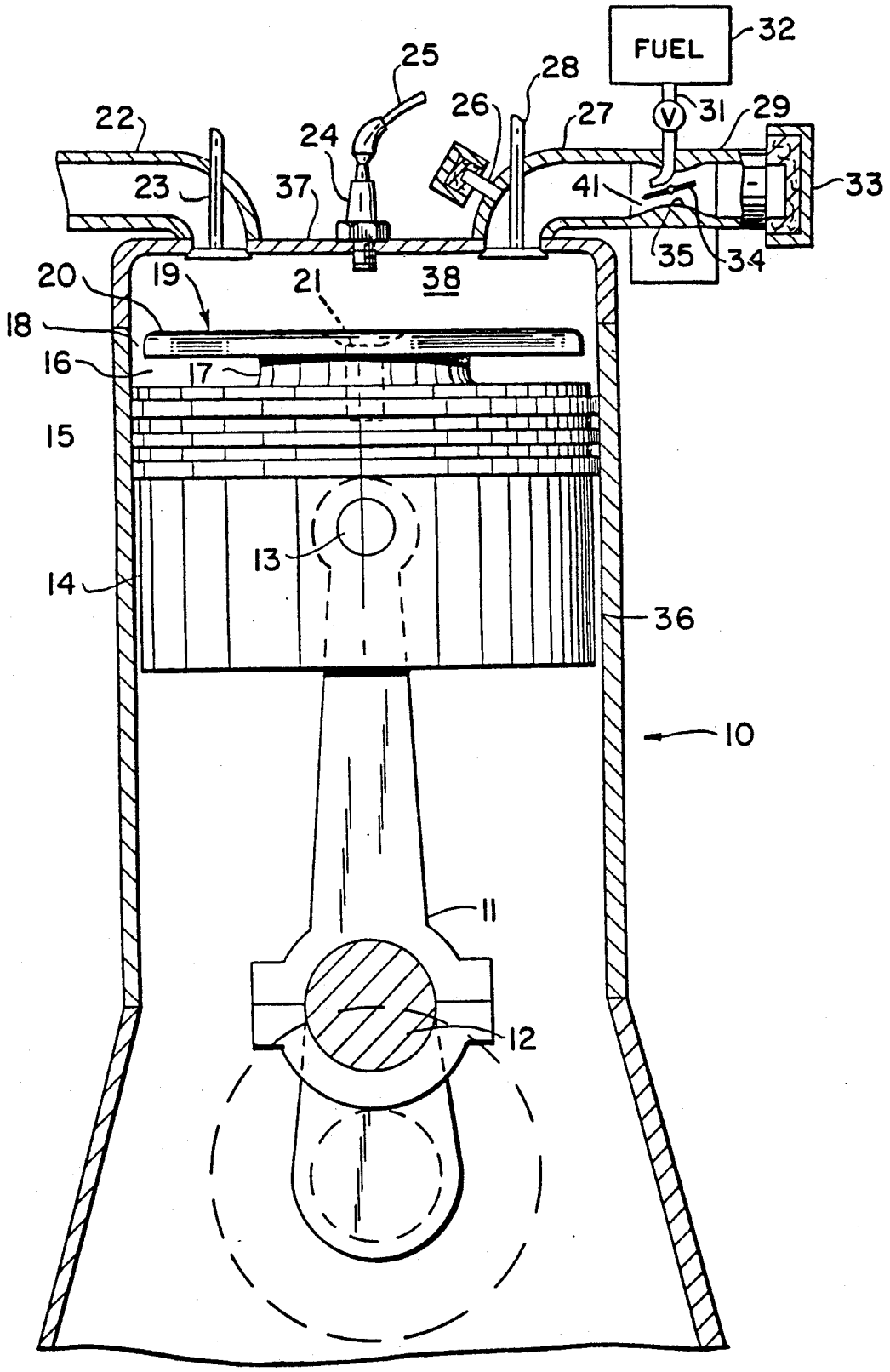
FIG. 4 is a diagrammatic representation of the inventive apparatus installed in an internal combustion engine.

Referring now to the drawing of FIG. 4, that shows a diagrammatic representation of an embodiment of a balancing chamber or reservoir formed on a piston for refining the Otto cycle of an internal combustion engine to function on a heat balanced with pressure exchange four stroke cycle. An engine housing or block 10 forms a chamber for a reciprocating piston 14 that is attached by means of wrist pin 13 to connecting rod 11. A crankshaft 12 is coupled to connecting rod 11 by means of a journal bearing to permit reciprocating motion of piston 14 to be transformed into rotating mechanical energy that may be utilized to drive machinery, an automobile or like device, for providing work output.

The inner wall of engine housing 10, adjacent the wall of piston 14, forms a cylinder wall 36 that is in contact with rings 15 to provide a gas pressure tight seal between moving piston 14 and cylinder wall 36 to prevent the escape of high pressure gases generated by burning fuel in variable volume combustion chamber 38. Attached to engine housing 10 is cylinder head 37 forming a closed combustion chamber between the upper most portion of housing 10 and the inner recessed portions of the head. Cylinder head 37 has two ports, exhaust and intake, that open and close by means of operation of exhaust valve 23 and intake valve 28 arrangements, respectively. These valves are opened and closed in time sequence with the reciprocating movement of piston 14 by means of valve lifters, push rods, camshafts, and the like, not shown, to allow the internal combustion engine to operate on a four stroke Otto cycle.

Attached to the cylinder head 37 is an intake manifold 27 that forms a closed passageway for allowing the flow of fuel and atmospheric air to combustion chamber 38. An air filter 33 is provided to filter air entering a carburetor like device 29 through venturi 35, that has nozzle or port 41 attached to fuel container 32 via a valve and fuel line 31. Air flowing through venturi 35 creates a vacuum to draw fuel from fuel container 32 into combustion chamber 38. Carburetor like device 29 may be replaced by other fuel delivery devices such as fuel ejectors or like devices, known to those skilled in the art. A throttle plate 34 attached to a linkage arrangement, not shown, controls the amount of vacuum through venturi 35 by restricting air flow through the venturi for controlling the amount of fuel delivered to the engine. An additional linkage arrangement, not shown, may be coupled to control air flow through air inlet 26 to further control the amount of atmospheric air delivered to the engine during its operation. Air inlet 26, open to atmospheric air, permits a large volume of air to be delivered to combustion chamber 38 on the intake stroke of the engine prior to delivery of any fuel laden air charge. This air vent is positioned adjacent intake valve 28, as shown, but may be located at any position between carburetor device 29, a fuel ejector or the fuel delivering device, and the intake valve port of intake valve 28.

A spark plug 24 is attached in cylinder head 37 in a conventional manner, and operates to deliver an electric voltage to create a spark in combustion chamber 38 in proper timing sequence with other engine elements to ignite fuel within combustion chamber 38, for creating power to drive piston 14.

A cap like element 19 is centrally attached to piston 14 at its surface face by means of a rivet, bolt or like fastening device. This cap like portion 19 is of mushroom-like shape with a thickened cylindrical stalk-like center proton that has one of its circular face surfaces in contact with the circular surface of piston 14. Integral with the other circular surface of stem-like portion 17 is a relatively thin, radially extending cylindrical lip 20 having a periphery that is spaced a predetermined distance from cylinder wall 36 to form gap or passageway 18. The remaining exposed surface of piston 14, the dimensional height of the stem-like portion 17, and inner surface of lip 20, form a chamber 16 open to the combustion chamber by a gap or passageway 18, defined by the inner cylinder wall surface and the edge of lip 20 which may extend the entire outer peripheral distance of top 19 or some predetermined portion, thereof. Chamber 16 is sealed on its lower side by means of piston rings 15. The reservoir 16 is thus formed by a portion of the top surface of portion 14, an inner surface portion of lip 20, the cylindrical sidewall, and the cylindrical wall of stem element 17.

Figure 4A:
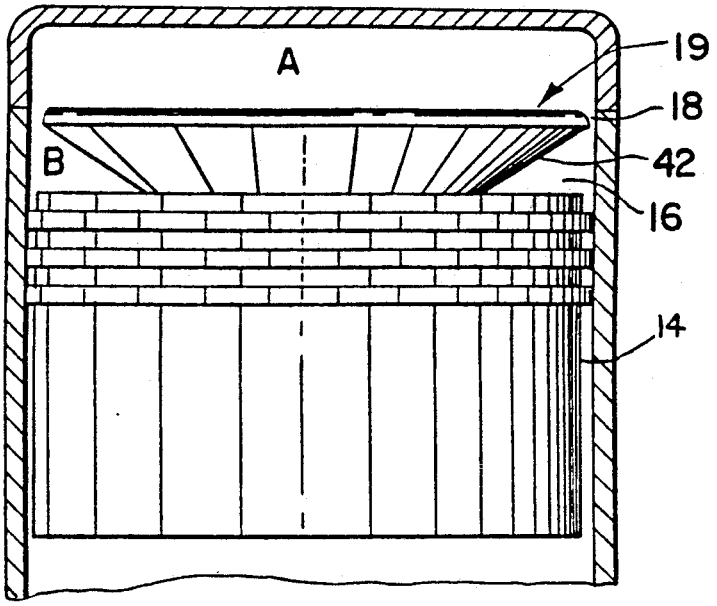
FIG. 4*a* and 4*b* are diagrammatic representations of pressure exchange cap shape.
Figure 4B:
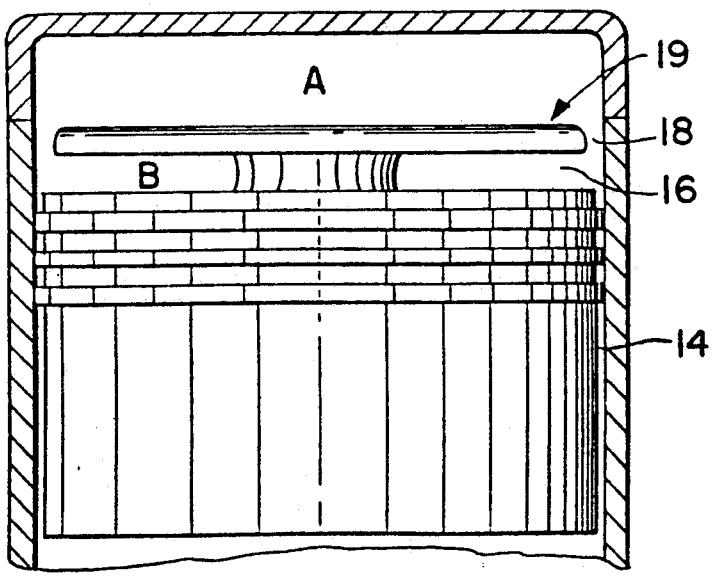

Although cap like element 19 is described as fastened to the piston it is to be understood that cap 19 may be integral with piston 19 and the chamber may be machined or shaped in the piston in the same manner as piston ring grooves. Additionally, it is to be understood that although chamber 16 is shown as formed with parallel sides, the underside of lip 20 may be sloped towards the piston top as shown in FIG. 4A or constructed with diametrically opposing sides to form a balancing chamber or reservoir 16 without departing from the spirit of the invention. FIGS. 4A and 4B show cap configurations and combustion chamber geometries, as well as volumes A and B, representing, respectively, combustion chamber minimum volume and reservoir chamber volume.

The principle of operation of an internal combustion engine on the heat balanced with pressure exchange cycle may be best understood by reference to FIG. 3 which shows a p-v diagram of the ideal theoretical heat balanced with pressure exchange cycle and FIG. 5 (A through G) that illustrates the operating sequence of an embodiment of heat balanced with pressure exchange cycle during its four stroke operation. FIG. 5A illustrates piston 14 completing an exhaust stroke with the exhaust valve 23 about to close, with piston 14 moving upward forcing the flow of the burned gases, detected by arrows, out through the exhaust valve port through a passageway in exhaust manifold 22. A this point intake valve 28 is closed and no air of fuel 16 flowing through intake manifold passageway 27. Air vent 26 located adjacent the inlet valve port has allowed a charge of fuel free air at atmospheric pressure to fill the entire volume of the intake passageway in the intake manifold up to and through venturi 35. As intake valve 28 opens, best shown with reference to FIG. 5B, piston 14 positioned near top dead center (TDC) moves downwardly enlarging the space at the top of the cylinder, atmospheric air pressure and a decrease in air pressure due to the receding piston draws an inflow of air filling the space in the cylinder. The inflow of air first entering the combustion chamber 38 is the charge of air within the intake manifold passageway that is replenished somewhat by air vent 26 before sufficient vacuum is generated in venturi 35 to next draw a charge of rich fuel laden air into the cylinder chamber after the air has been first admitted. As the piston reaches its lowest position, bottom dead center (BDC), the cylinder space has been filled with a fuel-air charge varying from rich near cylinder head 37 to substantially fuel-free air near piston 14.

Figure 5A:
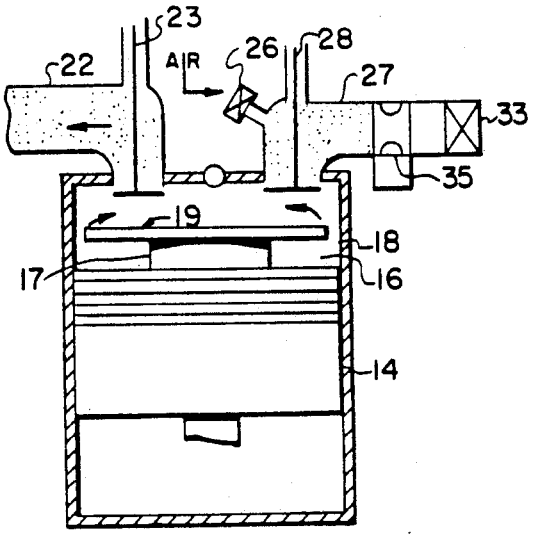
FIG. 5 (A–G) are illustrations of the sequence of operation of a heat balanced with pressure exchange engine cycle.
Figure 5B:
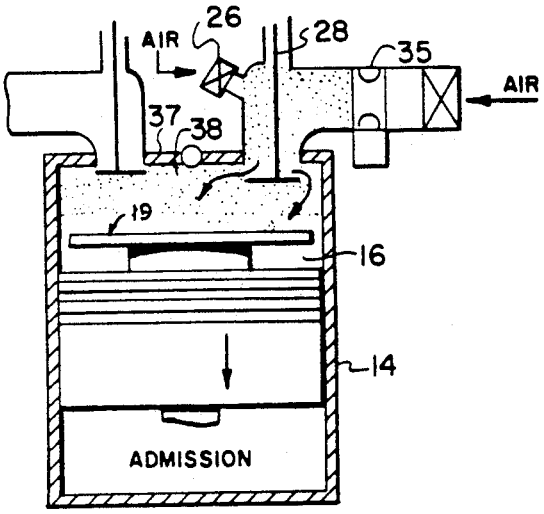
Figure 5C:
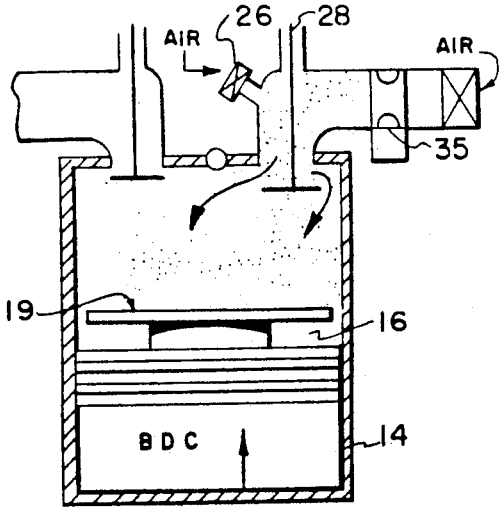

As piston 14 reaches its lower most point of travel within the cylinder, (BDC), the pressure inside the cylinder is still less than atmospheric pressure and additional air and fuel can enter the cylinder, even after the cylinder begins to move upward. Therefore, the intake valve 26 does not close until the crankshaft arm 11 is a predetermined amount of travel past BDC, this is best shown by the illustration of FIG. 5C.

Figure 5D:
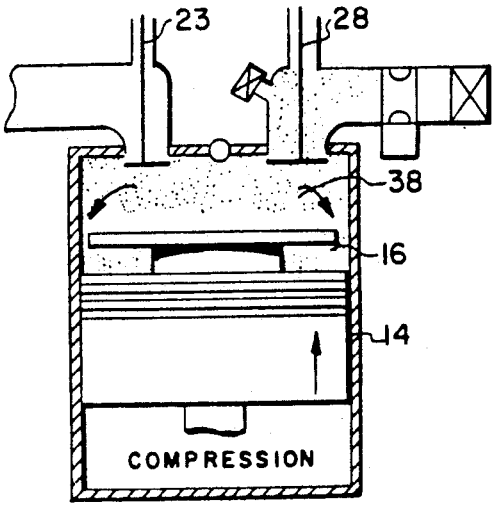

After the intake stroke, best shown by reference to FIG. 5D, both valves (23, 28) are closed and piston 14 moves upward on the compression stroke. Piston 14 compresses the air and fuel charge by pushing it upward into a small decreasing space between the top of the cylinder and the cylinder head that forms combustion chamber 38. Throughout the upward movement of piston 14 the substantially fuel-free air in chamber 1 is also compressed, since the passageway 18 does not prevent pressure equalization between the reservoir and combustion chambers. During operation of the engine the burning gases heat cap 19 which acts as a heat exchanger and causes heating of the fuel charge during compression as the air and charge flows over and around it, thus providing additional heating of the gases.

Figure 5E:
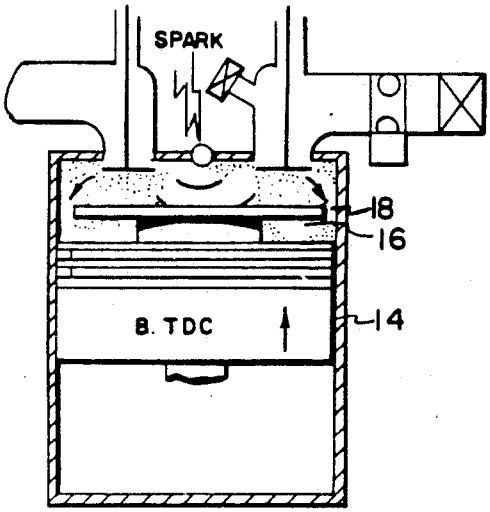
Figure 5F:
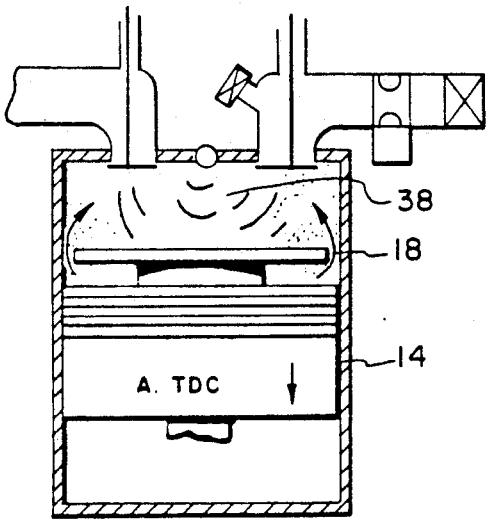
Figure 5G:
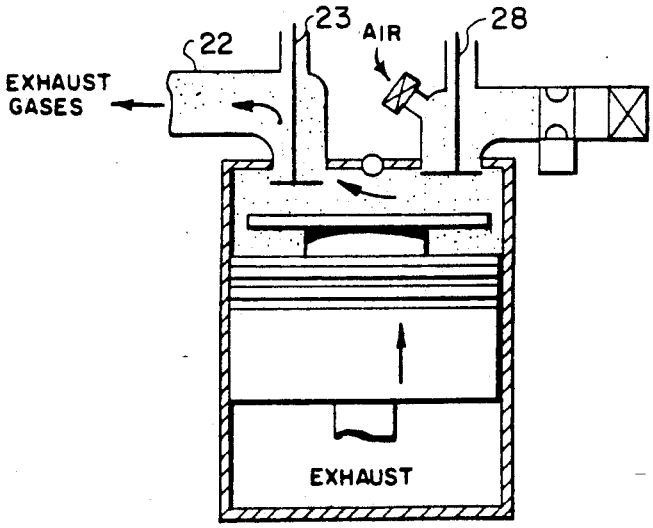

FIG. 5E, illustrates the initiation of combustion with piston 14 near TDC and both valves closed. Piston 14 has compressed the air fuel charge, at this point, a spark ignites the fuel and it reacts in oxygen with an explosive force. The pressure increase generates a compression shock wave that is driven into reservoir 16, via passageway 18, momentarily compressing the air therein against the internal walls of reservoir 16. Simultaneously, the expansion wave created by reflection of the compression wave from the top of cap 14 and deflected toward cylinder head 37 decreases the pressure in combustion chamber 38 in the region of passageway 18. A pressure imbalance thus occurs causing the air within chamber 16 to expand out via passageway 18 into combustion chamber 38. Air flow out of chamber 16 under these conditions can occur even though total or average pressure in the combustion chamber may be equal to or even greater than total or average pressure in reservoir chamber 16 because of this pressure imbalance caused by the oscillating wave action in the immediate region of the passageway 18. In this manner, that is, by the pressure exchange that occurs when the system is functioning in the desired manner, controlled flow of heated, highly compressed oxygen can flow out from the reservoir chamber in an oscillating manner due to occurrence of alternating pressure-expansion waves across the gap during the entire combustion or reaction event. In addition, since the pressure exchange occurs during the entire combustion cycle, the pressure exchange phenomenon is inherently quite independent of piston position and, as indicated previously, independent of total pressure in the combustion chamber.

In a conventional manner, the thermal potential derived from the fuel/air reaction increases the total pressure in the combustion chamber to drive the piston, connecting rod 11 and crankshaft 12 to produce useful work.

The exhaust stroke beings when the piston reaches BDC at the end of the expansion of power stroke, best shown with reference to FIG. 5C. Exhaust valve 23 opens, piston 14 moves upward in the cylinder and forces the burning gases out through the exhaust passageway 22 via exhaust port into exhaust manifold 22. At the end of the exhaust stroke, exhaust valve 23 closes and the intake stroke starts to repeat the engine cycle.

The interaction of the reservoir and the combustion chambers is crucially important for proper heat balance with pressure exchange engine cycle operation. To provide the necessary oscillation action of the compression expansion waves during the time period of the combustion event so that they successively interact within the combustion zone to provide a pumping action to cause fuel free air to flow from chamber 16 throughout the combustion event requires certain dimensional interrelationships of combustion chamber volume A, chamber volume B and passageway 18 (see FIGS. 4A and 4B). In an internal combustion engine the volumetric balancing ratio of B/A is normally n a range of from 0.20 to 3. The passageway opening 18 should be in the range of 0.05 to 0.200 inches measured across its narrow dimension. The lower value typical for standard size cylinder of automobile engines, the higher value typical for compression ignition engines. The passageway dimensions and configurations for each engine are developed based on the parameters of the particular engine involved to enable pressure exchange to occur during the entire combustion event. Unless the interrelationships are correct, the oscillating compression/expansion waves will not enable the pressure exchange to function to fully occur, due to, among numerous reasons, fuel poisoning of the air in the reservoir chamber, quenching of combustion due to excess air supply during combustion, insufficient flow of air from the reservoir chamber and disturbance of the pressure exchange in the gap area.

Table 1 sets froth the pressures and temperatures present at designated points on the pressure-volume curves of FIGS. 1 and 3 in comparison of two identical engines; one operating on a heat balanced cycle and the other on an Otto cycle.

TABLE 1

| Otto Cycle = 8 $\beta = 0$ | | | Heat Balanced Cycle = 8 $\beta$-.43 | | |
|---|---|---|---|---|---|
| State | Psia | T° R | Psia | T° R | State |
| a | 14.7 | 600 | 14.7 | 600 | a |
| a | 240 | 1200 | 240 | 1200 | b |
| c | 1000 | 4980 | 670 | 2800 | c |
| c | 1000 | 4980 | 670 | 3070 | c' |

A two-stroke engine cycle that has a similar combustion cycle as the four stroke but that requires only one revolution of the crank shaft can also be modified to operate on a heat balanced cycle.

The compression stroke of the working piston draws a fresh supply of air into the crank case. On the next compression stroke this air charge is compressed in the combustion chamber and fuel is then injected into the combustion chamber. A cap structurally similar to the one described above operates in the same manner to sustain combustion during the burning of fuel-air charge in the combustion chamber to cause the engine cycle to be refined to a heat balanced cycle.

The described apparatus used to modify reciprocating internal combustion engines, that is, to produce power by pistons moving up and down in cylinders for driving a crankshaft which changes the up-and-down motion to rotary engines; that is, engines in which power is produced by the action of a rotor turning inside an oval shaped combustion chamber, e.g. the WANKLE engine.

Figure 6:
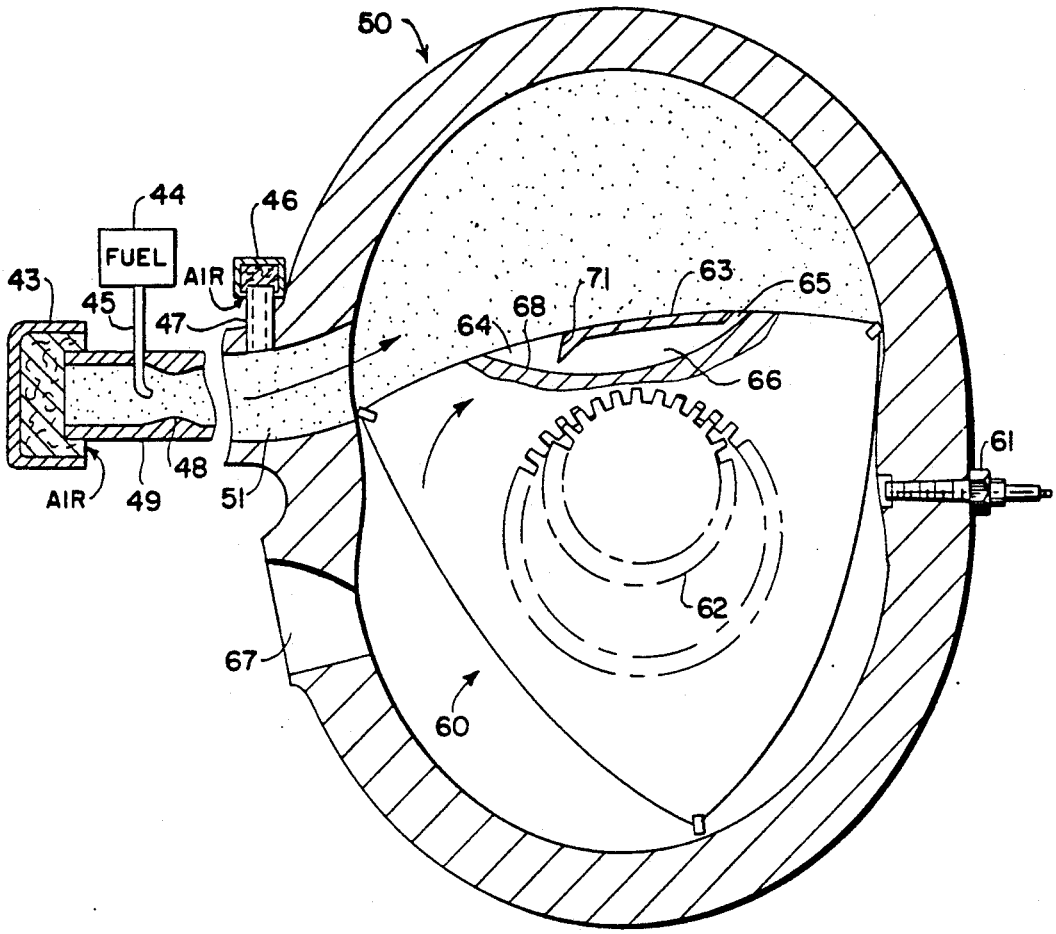
FIG. 6 is a diagrammatic representation of the inventive apparatus installed in a rotating internal combustion engine.

The conventional piston is replaced with a three-sided rotor 60, best shown with reference to FIG. 6. Rotor combustion pockets are rotated past an intake port 51, a spark plug 61 and an exhaust port 67 to cause rotating combustion. The combination cycle follows the familiar pattern of the conventional four-stroke-cycle, Otto cycle, of an internal combustion engine in the sequence of events-intake, compression, power and exhaust, as shown in the pressure-volume graph illustrated in FIG. 1. Modification of the engine with reservoirs will refine its cycle so that it operates on a heat balanced with pressure exchange cycle, illustrated in FIG. 3, in a similar manner as the explanation above with respect to the reciprocating engine.

Figure 7:
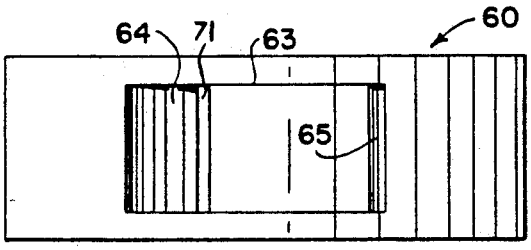
FIG. 7 is a partial cross-section view of the rotor showing construction features of the balancing chamber or reservoir.

FIG. 6 illustrates a rotary engine 50 having a rotor 60 that has been modified with a reservoir 66. The reservoir 66 is formed by partial closing of the normal depressions 68 in the rotor 60 with a shaped plate like member 63, or cap, that extends across depression 68, best shown with reference to FIG. 7. An opening or passageway 64 is formed by a surface of the cup-like depression and an elongated lip-like projection 71 formed on one edge of closure element 71. Lip-like portion projects inwardly toward the depression to form a tapered restricted opening defining a passageway at the mouth of balancing chamber 66. A substantially smaller opening 65 is located at the rear of reservoir 66 so that the reservoir 66 has a half circle segmental cross-sectional area that tapers gradually in extending from lip 71 to opening 65. It is to be understood that other shaped chambers may be used as long as the balancing ratio of the volumes, formula 7, is considered. Although only a single reservoir is shown on rotor 60, it is to be understood that a reservoir of similar design is positioned on each of the other two rotor lobes shown. A shaft 62 with appropriate internal and external gearing is connected to rotor 60 for transmission of power to an external load.

Rotary engine 60 has two ported openings, intake 51 and exhaust 67, for intake and exhaust of gases, respectively. An intake tubular passage 49 formed with a venturi section 48 is attached to the housing of engine 50 and has its other end open to atmospheric air by means of a filter 43. A fuel supply tank 44 attached by means of fuel line 45 to extend adjacent to venturi 48 draws fuel into engine 50 by a lowered pressure area caused by air flow through venturi 48. An additional air vent 47, closed by filter 46 is positioned between the inlet port 51 and fuel port for supply of atmospheric air to passageway 49. It is to be understood that other fuel supply means such as fuel ejectors or like fuel delivery devices may be used for supplying fuel to rotary engine 50.

In operation. rotor 50 revolves around its own geometric center; at the same time, internal gears 62, within rotor 50, move its center in an eccentric path. The result is all three corners of the rotor lobes are in constant contact with the housing walls. As rotor 50 revolves, the three rotor lobes form three moving combustion chambers that are constantly changing in volume. This action in each of the three combustion chambers brings about the intake. compression, power and exhaust effect that is similar to the four-stroke cycle of the reciprocating engine.

FIG. 6 illustrates the rotor 60 at intake stroke in the combustion chamber of the rotor lobes equipped with balancing chamber 66. The intake port 51 has been uncovered by moving rotor and the combustion chamber begins to fill with our in passageway 49 and additional atmospheric air supplied by air vent 47. Immediately, thereafter, a fuel rich charge is supplied by means of venturi 48, fuel line 45 and air flowing through air filter 43. The first lean air in the combustion chamber flows in reservoir 66 and as the air/fuel charge continues to fill the combustion chamber the fuel rich air extends in a rich to lean mixture from the combustion housing to the rotor surface. As rotor 50 continues it closes the intake port 51 and the combustion chamber contains the maximum air-fuel charge. Continued rotation of the rotor decreases the volume of the combustion chamber, compressing the air/fuel charge and forcing air into the reservoir 66. A spark plug 61 ignites the compressed charge of gas causing expansion of the gases. Compression shock waves are driven into balancing chamber 66. At the same time the expansion wave which drives the shock wave propagates by reflection back into the combustion chamber, decreasing pressure in the gap. Because a pressure imbalance occurs due to the shock waves the air within balancing chamber will flow out into the combustion chamber to supply air to sustain more complete burning. This oscillating action of compression-expansion continues a multiplicity of times throughout the combustion event and thus supplies air during the entire combustion cycle in timed sequential relationship with the turning of rotor 60 dependent on ratio of the volume of the combustion chamber with respect to the volume of the reservoir and the size of passageway 64. The action of the balancing is to supply air and this air is such a lean mixture that no combustion of gases takes place in reservoir 66.

As can be seen from the above description, the present invention provides an apparatus and techniques for providing control of pressure and temperature in the operation of an internal combustion engine either reciprocating or rotary of spark or compression ignition and two or four stroke configuration in a refined thermodynamic cycle by providing a balancing chamber and passageway or gap parameters that have a relationship with the combustion chamber volume of the engine. Variation of these parameters within certain limits will allow an engine to operate on a balanced heat with pressure combustion cycle that has many of the advantages of both the Otto and Diesel cycles with few or none of their disadvantages. In particular an engine operating on a balanced cycle has better operating engine performance, overall engine speed and load conditions, better fuel economy and less emission of pollutants. These are some of the advantages not found in the prior art technique and devices mentioned above.

Obviously many modifications and variations of the present invention are possible in light of the above teachings. It is therefore to be understood that within the scope of the appended claims the invention may be practiced otherwise than as specifically described.

What is claimed is:

1. In an internal combustion engine including a variable volume combustion chamber into which is admitted a fuel air charge during at least part of an intake and compression event forming part of the operating cycle of the engine, such charge being compressed during at least part of the intake and compression event, reacted during a combustion/expansion event, and discharged during an exhaust event; a piston means movable within a cylinder to vary its volume between the piston means and the head of the cylinder, said combustion chamber disposed between the piston means and the head of the cylinder; means for independently supplying air and fuel to the combustion chamber in timed relationship with the movement of the piston means, and inlet and exhaust valves for controlling admission of air and fuel into the combustion chamber through an intake port and discharging of combustion products from the combustion chamber through an exhaust port, respectively, the improvement comprising:

a. means for supplying substantially fuel-free air alone to the combustion chamber through the intake port during the initial part of each charge intake and compression event;

b. means for supplying fuel into the combustion chamber during a later part of each charge intake and compression event, whereby the proportion of fuel to air of each charge varies from excess fuel near the intake port to substantially fuel-free air near the piston means at the beginning of the compression event;

c. an air reservoir chamber means;

d. a passageway between the combustion chamber and air reservoir chamber, said passageway providing restricted communication between said reservoir chamber and combustion chamber; the passageway, combustion chamber and reservoir chamber having geometric configurations that permit transmittal therethrough of pressure shock waves incidental to a combustion event in the combustion chamber, and provide controlled pumping of air compressed by said shock waves from the reservoir chamber into the combustion chamber throughout the combustion event independently of total pressure in the combustion chamber or piston position due to the interaction of shock compression and expansion waves in the vicinity of the passageway;

e. said piston means including a reciprocating piston element, and including a member on the top of the piston element extending towards the cylinder head, said member including a radially extending lip portion spaced from and extending along the wall of the cylinder, and spaced above the piston element; said reservoir chamber occupying the area between said lip and the top of the piston element; said passageway having a width and length defined respectively as the distance between the lip and the cylinder wall, and the circumferential distance along the cylinder wall over which the lip extends; said passageway width being between 0.05 and 0.20 inches (1.27 and 5.08 mm); and f. the ratio between the reservoir chamber volume and the combustion chamber minimum volume being between 0.2 and 3.0.

2. An internal combustion engine as claimed in claim 1, said passageway having a uniform width and a length extending over the major portion of the periphery of the piston element.

3. An internal combustion engine as claimed in claim 1, including a charge intake manifold located upstream of the intake port, said air supply means including an air supply valve means located in said manifold upstream of and closely adjacent said inlet valve, and means for controlling said air supply valve for enabling air to be admitted into the intake manifold adjacent the inlet valve between inlet valve openings.

4. An internal combustion engine as claimed in claim 3, said air and fuel charge being admitted by aspiration through said intake port, and including externally energized ignition means in the combustion chamber for initiating combustion of the charge.

* * * * *